US007896149B2

(12) United States Patent
Tabata et al.

(10) Patent No.: US 7,896,149 B2
(45) **Date of Patent: *Mar. 1, 2011**

(54) CHANGE REPLENISHMENT MANAGEMENT SYSTEM AND COIN ROLL STORAGE

(75) Inventors: Ryuichi Tabata, Yokohama (JP); Hiroshi Tone, Tokyo-To (JP); Yoshiro Oie, Tokyo-To (JP); Takahiro Washizu, Tokyo-To (JP); Mikito Imai, Ako (JP); Yumiko Imai, legal representative, Ako (JP); Koichi Nishida, Tokyo-To (JP); Tsutomu Iwata, Yokohama (JP); Kazuyuki Shimizu, Yashio (JP)

(73) Assignee: Glory Ltd., Hyogo-Ken (JP)

( * ) Notice: Subject to any disclaimer, the term of this patent is extended or adjusted under 35 U.S.C. 154(b) by 274 days.

This patent is subject to a terminal disclaimer.

(21) Appl. No.: 11/886,689

(22) PCT Filed: Mar. 15, 2006

(86) PCT No.: PCT/JP2006/305140

§ 371 (c)(1),
(2), (4) Date: Dec. 17, 2008

(87) PCT Pub. No.: WO2006/109400

PCT Pub. Date: Oct. 19, 2006

(65) Prior Publication Data

US 2009/0171498 A1 Jul. 2, 2009

(30) Foreign Application Priority Data

Mar. 31, 2005 (JP) ..... 2005-102577
Mar. 31, 2005 (JP) ..... 2005-102617

(51) Int. Cl.
*G07D 7/00* (2006.01)

(52) U.S. Cl. ..... 194/302; 194/217; 194/320; 194/334; 453/1; 453/2; 453/16; 453/58; 453/61; 221/196; 221/263; 700/236; 700/242; 700/244; 700/231

(58) Field of Classification Search ..... 194/215–217, 194/302, 320, 334, 335; 453/1, 2, 16, 17, 453/58–62; 221/6, 129, 131, 132, 196, 263; 700/231, 232, 236, 237, 240–244
See application file for complete search history.

(56) References Cited

U.S. PATENT DOCUMENTS 7,591,361 B2 * 9/2009 McGunn et al. ..... 194/216

(Continued)

FOREIGN PATENT DOCUMENTS

JP 5-303672 11/1993

(Continued)

OTHER PUBLICATIONS

PCT Notification of Transmittal of Translation of the International Preliminary Examination Report (Form PCT/IB/338) for PCT/JP2006/305140 dated Jan. 2004.

(Continued)

*Primary Examiner*—Jeffrey A Shapiro
(74) *Attorney, Agent, or Firm*—Smith, Gambrell & Russell, LLP

(57) ABSTRACT

The change replenishment management system includes a coin roll storage (1), a coin change dispenser (3), and a POS register (5). A control unit (16) of the storage (1) detects the presence and the denomination of a coin roll in a storage section of each drawer (11, 12, 13) in accordance with an output signal generated from a detection system (18), and transmits the result of detection to the coin change dispenser (3). When loose coins obtained by unpacking removed coin rolls, which are removed from the storage (1), are introduced into an inlet (30), a control unit (36 or 50) of the change dispenser (3) or register (5) compares the denomination and the number of the loose coins, which are detected by identification unit (31), with the denomination and the number of the removed coin roll determined on the basis of the detection result transmitted from the storage (1), and judging the correspondence therebetween.

19 Claims, 6 Drawing Sheets

U.S. PATENT DOCUMENTS

| | | | | |
|---|---|---|---|---|
| 2008/0188169 | A1* | 8/2008 | Sakai et al. | 453/3 |
| 2009/0017740 | A1* | 1/2009 | Oie et al. | 453/58 |
| 2009/0166227 | A1* | 7/2009 | Imai et al. | 206/81 |

FOREIGN PATENT DOCUMENTS

| | | |
|---|---|---|
| JP | 7-249139 | 9/1995 |
| JP | 8-96212 | 4/1996 |
| JP | 10-188069 | 7/1998 |
| JP | 11-250314 | 9/1999 |
| JP | 11-288479 | 10/1999 |
| JP | 11-328485 | 11/1999 |
| JP | 2003-263682 | 9/2003 |
| JP | 2003-337969 | 11/2003 |

OTHER PUBLICATIONS

PCT International Preliminary Report on Patentability (Form PCT/IB/373) for PCT/JP2006/305140 dated Jan. 2004.

PCT Written Opinion of the International Searching Authority (Form/ISA/237) for PCT/JP2006/305140 dated Apr. 2005.

PCT Notification of the Recording of a Change (form /IB/306) for PCT/JP2006/305140dated Oct. 2005.

Japanese Office Action issue in corresponding Japanese Application No. 2004-268134 dated Aug. 27, 2010 together with an English translation.

* cited by examiner

CHANGE REPLENISHMENT MANAGEMENT SYSTEM AND COIN ROLL STORAGE

TECHNICAL FIELD

The present invention relates to a change replenishment management system that exercises management when loose coins obtained by unpacking coin rolls (bar-shaped coin rolls obtained by packing, e.g. wrapping, a fixed number of coins of the same denomination) are to be replenished as change to a coin change dispenser. The present invention also relates to a coin roll storage for storing coin rolls in their respective storage sections by denomination and managing the amount of housed money on the stored coin rolls.

BACKGROUND ART

A system disclosed, for instance, by JP2003-263682A is similar to the above-mentioned change replenishment management system. The system disclosed by JP2003-263682A includes a POS register, which has a coin change dispenser, and a packed coin processing apparatus, which is communication-connected to the POS register. This system ejects a coin roll (packed coins) from the packed coin processing apparatus as needed, unpacks the coin roll to obtain loose coins, and replenishes the loose coins to the POS register as change.

This change replenishment management system has the following problem. Information about the coin roll ejected from the packed coin processing apparatus is transmitted to the POS register. However, replenishment information about loose coins obtained by unpacking the coin roll is manually entered into the POS register, for instance, by a clerk (refer, for instance, to Paragraphs [0026] and [0027] of JP2003-263682A). Therefore, the accuracy of management is inadequate from the viewpoint of managing the relationship between the ejected coin roll and the loose coins replenished as change.

A coin roll storage disclosed, for instance, by JP11-250314A (1999) is similar to the above-mentioned coin roll storage. The coin roll storage disclosed by JP11-250314A is configured to sequentially detect the denomination of coin rolls stored in a cassette positioned in the storage main body to store a plurality of coin rolls. More specifically, the storage main body is equipped with a reflective optical sensor that moves at a constant speed in the direction where coin rolls stored in the cassette are arranged. The duration of each resulting sensor output is then determined. Eventually, the denomination of each coin roll is detected, for instance, from its diameter.

This coin roll storage has the following problems. It takes a considerable amount of time to detect denomination because it is necessary to set the cassette, which contains coin rolls, in the storage main body and then move the sensor as described above for detection purposes. Further, this coin roll storage is costly because it needs, for instance, a mechanism for moving the sensor at a fixed speed. Furthermore, if an attempt is made to detect the denomination of coin rolls in a plurality of cassettes, it is necessary to move the sensor in each cassette for detection purposes. It means that this coin roll storage entails more time and cost.

A coin roll storage disclosed, for instance, by JP2003-337969A is also similar to the above-mentioned coin roll storage. The coin roll storage disclosed by JP2003-337969A is configured to sequentially detect the denomination of coin rolls stored in a cassette positioned in the storage main body to store a plurality of coin rolls. More specifically, the storage main body is equipped with an image reader (scanner) that moves in the direction where coin rolls stored in the cassette are arranged. The denomination of each coin roll is detected in accordance with an image read by the scanner.

If it is detected that an incorrect coin roll is stored in a cassette (a coin roll is stored in a wrong cassette) regarding the denomination, a warning appears on a display screen. When an on-screen recheck key is pressed after repositioning the incorrectly stored coin roll in a proper cassette in accordance with the displayed warning, this coin roll storage retries to achieve denomination detection.

This coin roll storage has the following problems. First of all, the operator has to place cassettes, which store coin rolls, in the storage main body, let the scanner move to achieve denomination detection, and note the display screen to check for incorrectly stored coin rolls. Even when the coin roll storage retries to achieve denomination detection, the operator has to reposition the incorrectly stored coin roll in a proper cassette and then press the recheck key to repeat the same sequence. As such being the case, the operator does not promptly become aware of an incorrectly stored coin roll and cannot immediately perform a retry because of a complicated procedure. Further, if no remedial action is taken, for instance, after the scanner malfunctions to incur incorrect detection, the amount of housed money in the coin roll storage may become incorrect. However, no appropriate countermeasures are prepared.

DISCLOSURE OF INVENTION

The present invention has been made in view of the above circumstances. A first object of the present invention is to provide a change replenishment management system capable of accurately managing the relationship between a removed coin roll and loose coins replenished as change.

A second object of the present invention is to provide a low-cost coin roll storage capable of detecting the denomination of coin rolls stored in a plurality of storage sections of a drawer accurately within a short period of time.

A third object of the present invention is to provide a coin roll storage that permits the operator to become aware of an incorrectly stored coin roll promptly and perform a retry immediately and prevents the amount of housed money from becoming abnormal due to an erroneous detection.

In order to accomplish the first object of the present invention, there is provided a change replenishment management system comprising:

a coin roll storage for storing coin rolls of a plurality of denomination; and a coin change dispenser positioned near the coin roll storage and communication-connected to the coin roll storage, the change replenishment management system managing the replenishment of loose coins to the coin change dispenser, the loose coins being obtained by unpacking at least one removed coin-roll that is removed from the coin roll storage, the coin roll storage including:

a storage main body;

a coin roll drawer arranged to be pulled out of/pushed into the storage main body and provided with a plurality of coin roll storage sections each for storing one coin roll of a particular denomination;

a coin roll detector configured to detect the presence and the denomination of a coin roll in each coin roll storage section of the coin roll drawer; and a detection result transmitter configured to transmit a result of detection by the coin roll detector to the coin change dispenser, and the coin change dispenser including:

an inlet into which loose coins to be replenished as change are introduced;

an identification unit configured to identify the denomination and the number of loose coins introduced into the inlet; and judgment means for, when loose coins obtained by unpacking the removed coin roll are introduced into the inlet, comparing the denomination and the number of the loose coins identified by the identification unit, with the denomination and the number of the removed coin roll determined on the basis of the detection result transmitted from the coin roll storage, and judging the correspondence therebetween.

According to the above change replenishment management system, when loose coins obtained by unpacking removed coin roll are introduced into the inlet of the coin change dispenser, the judgment means of the coin change dispenser can compare the denomination and the number of loose coins identified by the identification unit, with the denomination and the number of removed coin roll determined on the basis of the result of detection by the coin roll detector in the coin roll storage, and judge the correspondence therebetween. This makes it possible to accurately manage the correspondence between the removed coin rolls and the loose coins replenished as change.

In order to accomplish the first object of the present invention, there is also provided a change replenishment management system comprising:

a coin roll storage for storing coin rolls of a plurality of denomination;

a coin change dispenser positioned near the coin roll storage and communication-connected to the coin roll storage; and a cash register positioned near the coin change dispenser and communication-connected to the coin change dispenser, the change replenishment management system managing the replenishment of loose coins to the coin change dispenser, the loose coins being obtained by unpacking at least one removed coin roll that is removed from the coin roll storage, the coin roll storage including:

a storage main body;

a coin roll drawer arranged to be pulled out of/pushed into the storage main body and provided with a plurality of coin roll storage sections each for storing one coin roll of a particular denomination;

a coin roll detector configured to detect the presence and the denomination of a coin roll in each coin roll storage section of the coin roll drawer; and a detection result transmitter configured to transmit a result of detection by the coin roll detector to the coin change dispenser, the coin change dispenser including:

an inlet into which loose coins to be replenished as change are introduced;

an identification unit configured to identify the denomination and the number of loose coins introduced into the inlet;

a coin roll information transmitter configured to transmit to the cash register the denomination and the number of the removed coin roll determined on the basis of the detection result transmitted from the coin roll storage; and a loose coin information transmitter configured to, when loose coins obtained by unpacking the removed coin roll are introduced into the inlet, transmit to the cash register the denomination and the number of the loose coins identified by the identification unit, and the cash register including judgment means for comparing the denomination and the number of the removed coin rolls and the denomination and the number of loose coins transmitted from the coin change dispenser, respectively, and judging the correspondence therebetween.

According to the above change replenishment management system, when loose coins obtained by unpacking removed coin roll are introduced into the inlet of the coin change dispenser, the judgment means of the cash register can compare the denomination and the number of removed coin roll determined on the basis of the result of detection by the coin roll detector in the coin roll storage, with the denomination and the number of loose coins identified by the identification unit of the coin change dispenser, and judge the correspondence therebetween. This makes it possible to accurately manage the correspondence between the removed coin rolls and the loose coins replenished as change.

In order to accomplish the second object of the present invention, there is provided a coin roll storage comprising:

a storage main body;

a coin roll drawer arranged to be manually pulled out/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to detect a longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll; and a coin roll detector configured to detect the presence and the denomination of a coin roll in each storage section of the coin roll drawer on the basis of the longitudinal displacement of the coin roll drawer detected by the displacement detector and the output signal from the diameter sensor.

According to the above coin roll storage, when the coin roll drawer is manually pulled out of/pushed into the storage main body, the coin roll detector detects the presence and denomination of a coin roll in each storage section of the drawer in accordance with drawer longitudinal displacement detected by the displacement detector and diameter sensor output dependent on whether light is blocked by a coin roll. In this instance, the denomination of a coin roll can be detected with reference to a coin roll diameter determined according to the drawer longitudinal displacement and diameter sensor output. When the drawer longitudinal displacement is used as described above, the diameter of a coin roll can be accurately determined no matter whether the drawer is manually pulled out/pushed in at somewhat varying speeds.

Consequently, the denomination of coin rolls stored in the plurality of storage sections can be accurately detected within a short period of time simply by manually pulling out of/pushing into the coin roll drawer. Further, it is no longer necessary to furnish a mechanism or other device for moving the sensor at a fixed speed although it was needed in the past. This makes it possible to reduce the cost of the coin roll storage. Amount-of-housed-money management of the coin rolls in the coin roll storage can be exercised particularly in accordance with a detection operation performed when the coin roll drawer is pushed in.

In order to accomplish the second object of the present invention, there is also provided a coin roll storage comprising:

a storage main body;

a plurality of coin roll drawers each arranged to be manually pulled out of/pushed into the storage main body in a horizontal longitudinal direction at least between a closed position and a pulled-out position, each of the coin roll drawers being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections thereof;

a displacement detector configured to detect the longitudinal displacement of each coin roll drawer relative to the storage main body;

a coin roll diameter sensor including a light-emitting unit and a light-receiving unit fastened to the storage main body to face each other with the respective light-transmittable sections of the coin roll drawers positioned therebetween, the diameter sensor being configured to output a signal depending on whether light is blocked by a coin roll; and a coin roll detector configured to detect the presence and the denomination of a coin roll in each storage section of any one of the coin roll drawers on the basis of the longitudinal displacement of the same coin roll drawer detected by the displacement detector and the output signal from the diameter sensor.

According to the above coin roll storage, when any one of the coin roll drawers is manually pulled out of/pushed into the storage main body, the coin roll detector detects the presence and denomination of a coin roll in each storage section of the same drawer in accordance with drawer longitudinal displacement detected by the displacement detector and diameter sensor output dependent on whether light is blocked by a coin roll. In this instance, the denomination of a coin roll can be detected with reference to a coin roll diameter determined according to the drawer longitudinal displacement and diameter sensor output. When the drawer longitudinal displacement is used as described above, the diameter of a coin roll can be accurately determined no matter whether the drawers are manually pulled out/pushed in at somewhat varying speeds.

Consequently, the denomination of coin rolls stored in the plurality of storage sections of any one of the drawers can be accurately detected within a short period of time simply by manually pulling out of/pushing into the same coin roll drawer. Further, it is no longer necessary to furnish a mechanism or other device for moving the sensor at a fixed speed although it was needed in the past. This makes it possible to reduce the cost of the coin roll storage. Amount-of-housed-money management of the coin rolls in the coin roll storage can be exercised particularly in accordance with a detection operation performed when each coin roll drawer is pushed in.

In order to accomplish the third object of the present invention, there is provided a coin roll storage comprising:

a storage main body;

a coin roll drawer arranged to be manually pulled out/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to detect a longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll;

a coin roll detector configured to detect the presence and the denomination of a coin roll in each storage section of the coin roll drawer on the basis of the longitudinal displacement of the coin roll drawer detected by the displacement detector and the output signal from the diameter sensor;

a memory unit holding the relationship between the location of each coin roll storage section in the coin roll drawer and the denomination of the coin roll to be stored in each coin roll storage section;

a lock mechanism configured to perform a locking operation to inhibit the coin roll drawer from being pulled out from the closed position when the coin roll drawer pulled out of the storage main body is pushed into the storage main body; and a controller configured to compare the denomination detected by the coin roll detector with the denomination held in the memory unit for each coin roll storage section of the coin roll drawer when the coin roll drawer is pushed in, and to control the lock mechanism not to perform the locking operation if the compared denominations are not consistent with each other for at least one coin roll storage section.

According to the above coin roll storage, when the drawer is pushed in, the coin roll detector detects the presence and denomination of a coin roll in each storage section of the drawer in accordance with drawer longitudinal displacement detected by the displacement detector and diameter sensor output dependent on whether light is blocked by a coin roll. In this instance, the denomination of a coin roll can be detected with reference to a coin roll diameter determined according to the drawer longitudinal displacement and diameter sensor output. When the drawer longitudinal displacement is used as described above, the diameter of a coin roll can be accurately determined no matter whether the drawer is manually pushed in at somewhat varying speeds.

Consequently, the denomination of coin rolls stored in the plurality of storage sections can be accurately detected within a short period of time simply by manually pushing in the coin roll drawer. If any coin roll is incorrectly stored, the lock mechanism does not lock the drawer when it is pushed in. Therefore, the operator who manually pushes in the drawer becomes aware of an incorrectly stored coin roll. After the operator becomes aware of such an incorrectly stored coin roll, the operator can perform a retry simply by pulling out the drawer, properly repositioning the incorrectly stored coin roll, and pushing in the drawer again. In other words, the operator becomes aware of an incorrectly stored coin roll without delay and can perform a retry immediately.

In order to accomplish the third object of the present invention, there is also provided a coin roll storage comprising:

a storage main body;

a coin roll drawer arranged to be manually pulled out/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to output pulse signals the number of which is proportional to the longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll;

a coin roll detector configured to detect the presence and the denomination of a coin roll in each storage section of the coin roll drawer on the basis of the longitudinal displacement of the coin roll drawer determined by the output signals from the displacement detector and the output signal from the diameter sensor;

a lock mechanism configured to perform a locking operation to inhibit the coin roll drawer from being pulled out from the closed position when the coin roll drawer pulled out of the storage main body is pushed into the storage main body; and a controller configured to control the lock mechanism not to perform the locking operation if a pulse rate exceeds a specific rate limit and/or a pulse acceleration exceeds a specific acceleration limit when the coin roll drawer is pushed in, the pulse rate being the number of pulse signals output from the displacement detector per unit time, and the pulse acceleration being a change in the pulse rate per unit time.

According to the above coin roll storage, when the drawer is pushed in, the coin roll detector detects the presence and denomination of a coin roll in each storage section of the drawer in accordance with drawer longitudinal displacement detected by the displacement detector and diameter sensor output dependent on whether light is blocked by a coin roll. In this instance, the denomination of a coin roll can be detected with reference to a coin roll diameter determined according to the drawer longitudinal displacement and diameter sensor output. When the drawer longitudinal displacement is used as described above, the diameter of a coin roll can be accurately determined no matter whether the drawer is manually pushed in at somewhat varying speeds.

Meanwhile, if the drawer is manually pushed in at an excessively high speed or its speed change per unit time (acceleration) is too high, an erroneous detection may occur due to coin roll movement within a drawer's storage section or detection failure of the displacement detector. In view of the above circumstances, when a pulse rate and/or pulse acceleration that corresponds to the drawer speed and/or drawer acceleration exceeds a specific speed limit and/or acceleration limit, respectively, the lock mechanism does not lock the drawer when it is pushed in. This causes the operator, who manually pushes in the drawer, to become aware of the possibility of erroneous detection. After the operator becomes aware of the possibility of erroneous detection, the operator can perform a retry simply by pulling out the drawer and then pushing it in. This makes it possible to prevent the amount of housed money from becoming abnormal due to an erroneous detection.

BEST MODE FOR CARRYING OUT THE INVENTION

An embodiment of the present invention will now be described with reference to the accompanying drawings. FIGS. 1 to 8 illustrate a change replenishment management system that uses a coin roll storage in accordance with an embodiment of the present invention. The system configuration of the present embodiment, the configuration of the coin roll storage, the configuration of a coin change dispenser, the operational advantages of the present embodiment, and modified embodiments will be sequentially described with reference to FIGS. 1 to 8.

[System Configuration]

Figure 1:
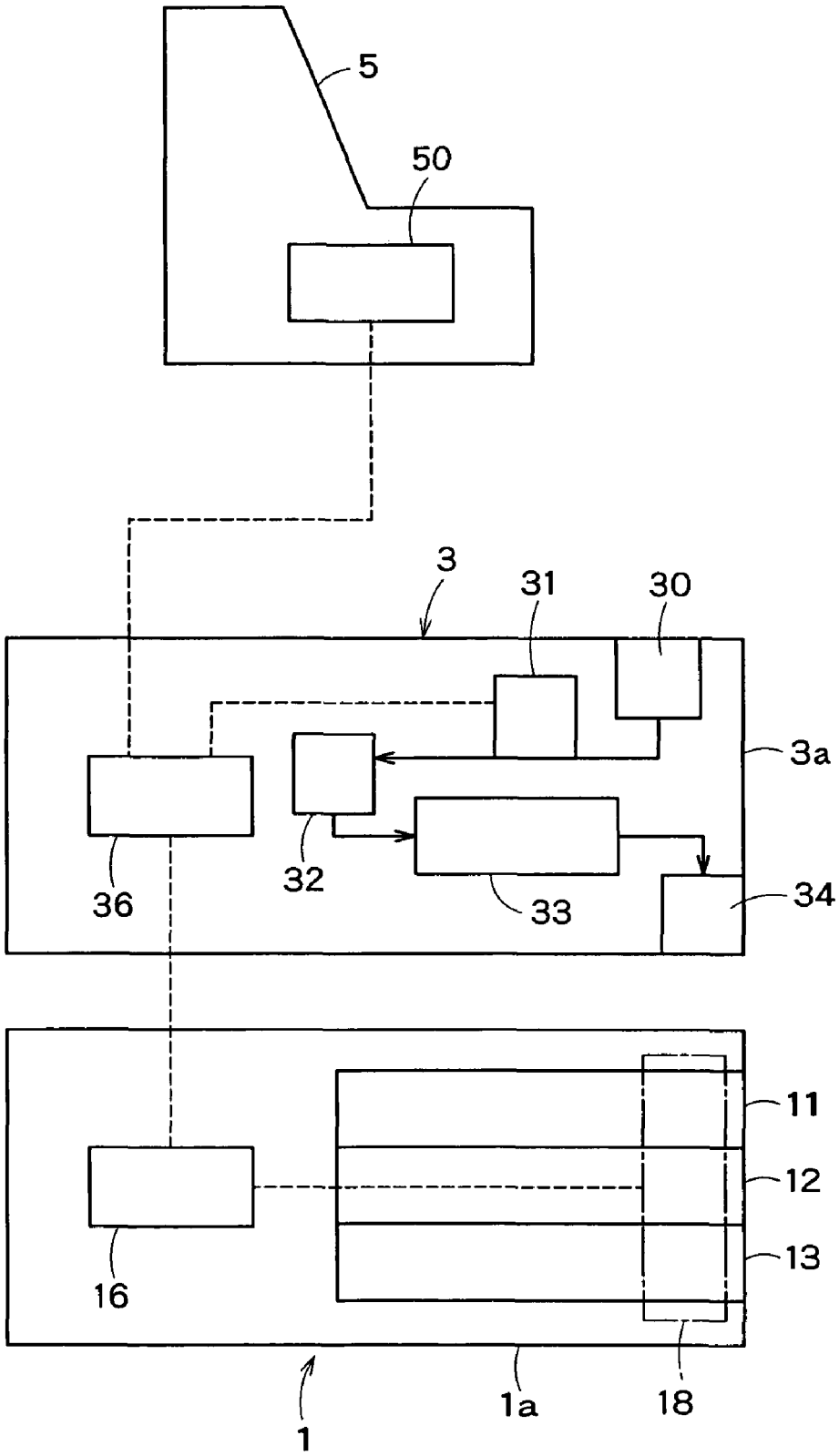
FIG. 1 is a block diagram illustrating a change replenishment management system that uses a coin roll storage in accordance with an embodiment of the present invention.
Figure 2:
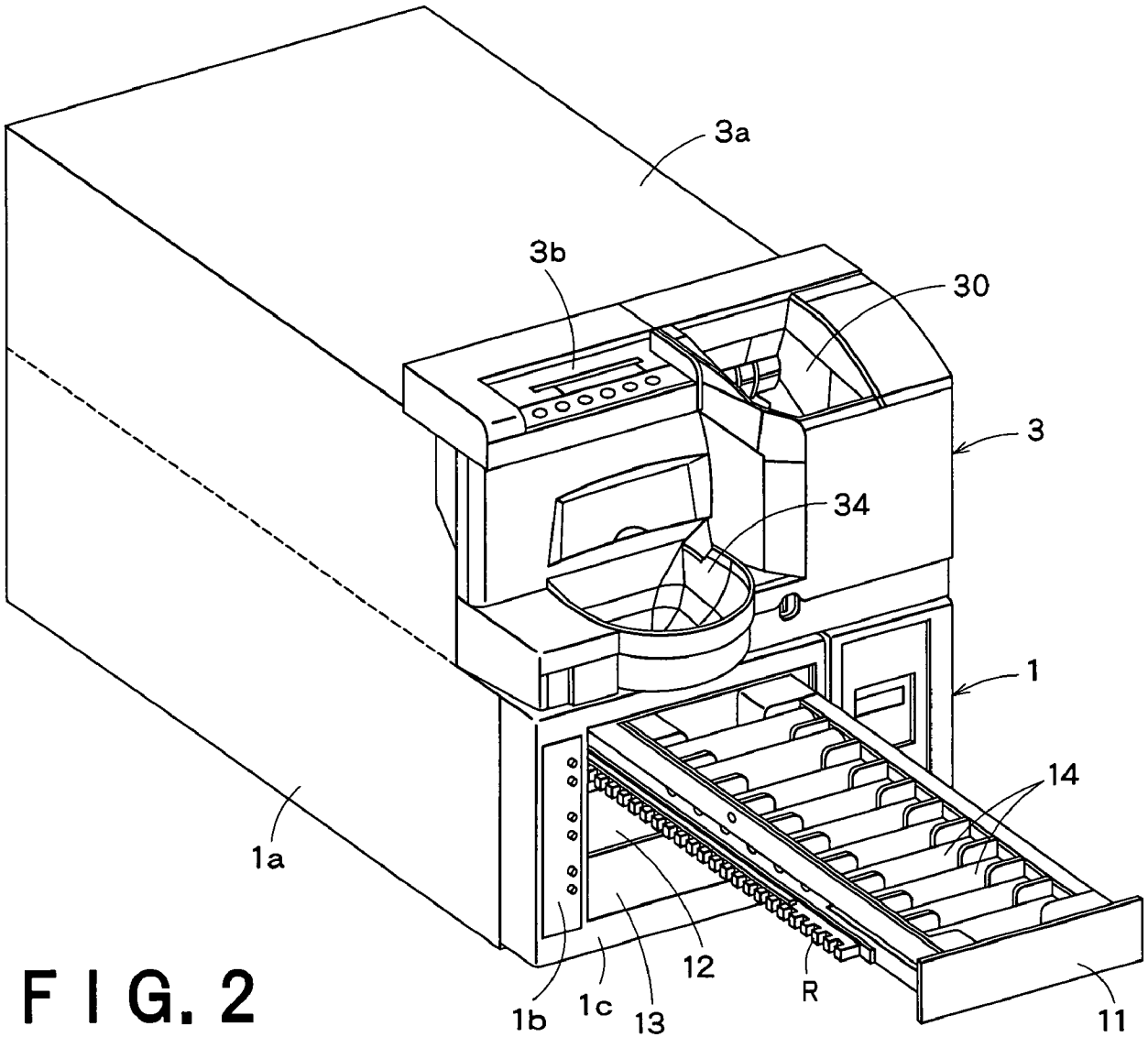
FIG. 2 is a perspective view illustrating a coin roll storage and coin change dispenser for use in the system shown in FIG. 1.

As shown in FIG. 1, the change replenishment management system according to the present embodiment includes a coin roll storage 1, a coin change dispenser 3, and a POS register (cash register) 5. As shown in FIG. 2, the coin roll storage 1 and the coin change dispenser 3 are integral with each other as they are vertically adjacent to each other. More specifically, a main body (housing) 1*a* of the coin roll storage 1 and a housing 3*a* of the coin change dispenser 3 are constructed of one piece. The POS register 5 is positioned near the coin change dispenser 3 and coin roll storage 1.

As shown in FIG. 1, the coin roll storage 1, coin change dispenser 3, and POS register 5 include control units 16, 36, 50, respectively. The control unit 16 of the coin roll storage 1 is communication-connected to the control unit 36 of the coin change dispenser 3. The control unit 36 of the coin change dispenser 3 is communication-connected to the control unit 50 of the POS register 5.

[Coin Roll Storage Configuration]

As shown in FIGS. 1 and 2, the coin roll storage 1 includes a storage main body 1*a* and three coin roll drawers 11, 12, 13. The coin roll drawers 11, 12, 13 are mounted in the main body 1*a* in such a manner that they can be manually pulled out forward (in a horizontal longitudinal direction). Each coin roll drawer 11, 12, 13 includes a plurality of coin roll storage sections 14 (FIG. 2). Each coin roll storage section can store one coin roll of a specific denomination. A coin roll in each storage section 14 faces widthwise and is in a horizontal position, the axis of the coin roll being orthogonal to the pull-out direction (longitudinal direction) of the coin roll drawer 11, 12, 13.

For example, an upper coin roll drawer 11 has eight 1-yen coin roll storage sections 14 and two 5-yen coin roll storage sections 14. A middle coin roll drawer 12 has eight 10-yen coin roll storage sections 14 and two 50-yen coin roll storage sections 14. A lower coin roll drawer 13 has eight 100-yen coin roll storage sections 14 and two 500-yen coin roll storage sections 14.

Further, the coin roll storage 1 includes a detection system 18 (FIG. 1), which outputs a signal for detecting the presence and denomination of a coin roll in each coin roll storage section 14 of the coin roll drawers 11, 12, 13. The control unit 16 of the coin roll storage 1 functions as a coin roll detector configured to detect the presence and denomination of a coin roll in each storage section 14 of a particular drawer 11, 12, 13 in accordance with a signal output from the detection system 18. Further, a display panel 1*b* is mounted on the front surface of the main body 1*a* of the coin roll storage 1. In accordance with the results of detection by the control unit 16 that serves as the coin roll detector, the display panel 1*b* indicates, for instance, whether the coin roll storage sections for various denominations are FULL or EMPTY.

In this document, coin rolls removed from the coin roll drawers 11, 12, 13 of the coin roll storage 1 (normally by a register clerk) are referred to as "removed coin rolls."

Figure 3:
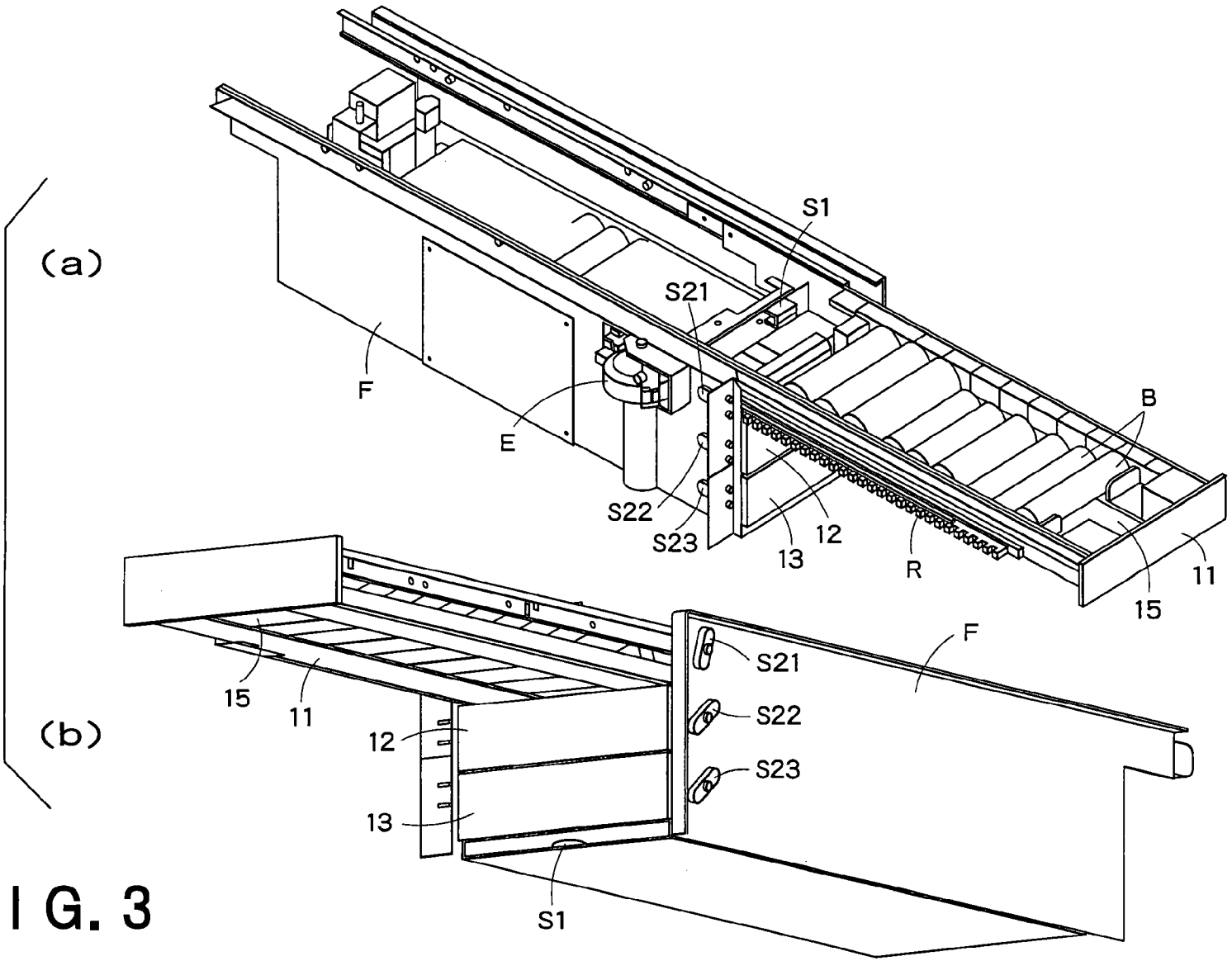
FIG. 3 shows an internal structure of the coin roll storage shown in FIG. 2, as (a) an upper perspective view and (b) a lower perspective view.
Figure 5:
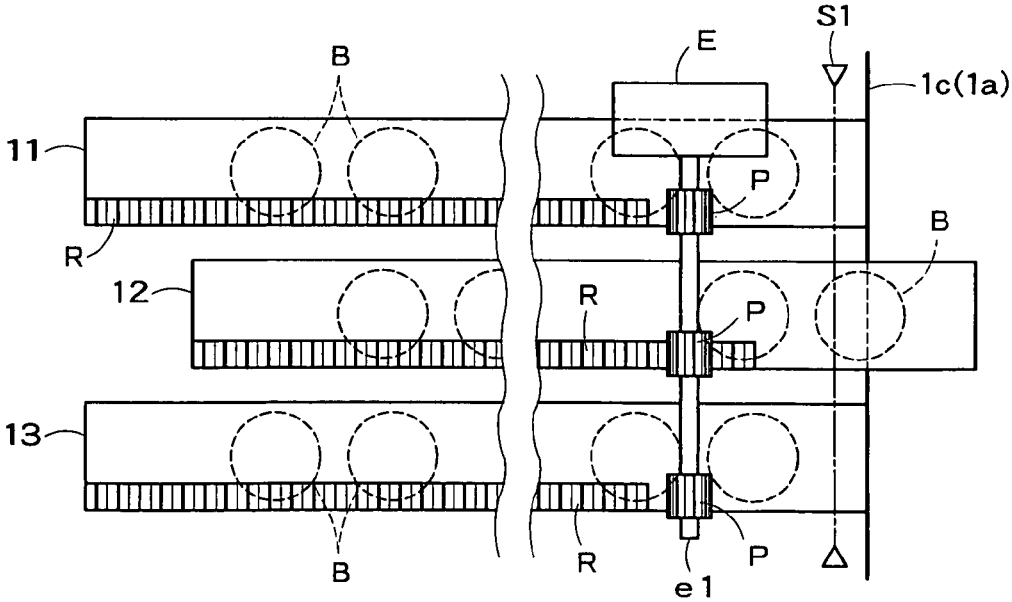
FIG. 5 is a side view that schematically shows the relationship between coin roll drawers and displacement detector in the coin roll storage shown in FIG. 2.

FIG. 3 shows a frame F that is furnished inside the main body 1*a* (FIG. 2) of the coin roll storage 1. The frame F retains the coin roll drawers 11, 12, 13 in such a manner that the coin roll drawers can be slid in the longitudinal direction. The bottom of each drawer 11, 12, 13 is provided with a light-transmittable section (opening or transparent section) 15 that is extended in a longitudinal direction in the widthwise central area. The light-transmittable section 15 is extended over the plurality of storage sections 14 (FIG. 2) of each drawer 11, 12, 13. The light-transmittable section 15 is further extended to a position near the leading end of each drawer, which is positioned forward of the foremost storage section 14. As shown in FIG. 5, a rack R extended in the longitudinal direction is positioned on the left-hand side of each drawer 11, 12, 13.

Figure 4:
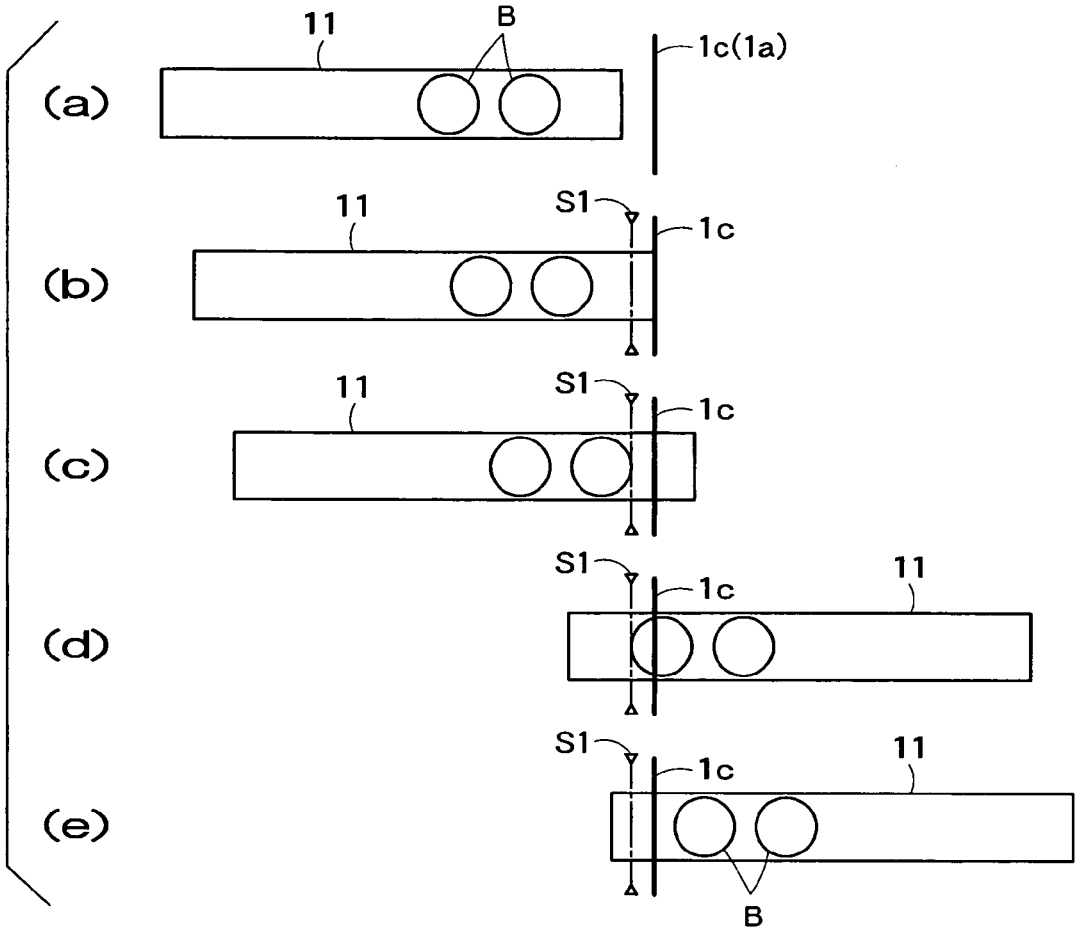
FIG. 4 schematically shows a coin roll drawer of the coin roll storage shown in FIG. 2, in (a) a pushed-in position, (b) a closed position, (c) a detection start/end position, (d) a detection end/start position, and (e) a pulled-out position.

FIG. 4 shows various longitudinal positions of a drawer 11, which represents the three drawers 11, 12, 13, with reference to a front panel 1*c* (see FIG. 3) on the main body 1*a*. FIG. 4(*b*) shows a "closed position" at which the front surface of the drawer 11 is substantially flush with the front panel 1*c*. FIG. 4(*a*) shows a "pushed-in position" at which the drawer 11 is pushed inward beyond the closed position until the front surface of the drawer 11 is slightly retracted from the front panel 1*c*. FIG. 4(*c*) shows a "detection start/end position" at which the drawer 11 is pulled out to start a detection operation of the detection system 18 (FIG. 1) and pushed in to terminate the detection operation of the detection system 18. FIG. 4(*d*) shows a "detection end/start position" at which the drawer 11 is pulled out to terminate the detection operation of the detection system 18 and pushed in to start the detection operation of the detection system 18. FIG. 4(*e*) shows a "pulled-out position" at which the drawer 11 is pulled out so that coin rolls B can be stored in/removed from all storage sections 14 (FIG. 2) of the drawer 11. FIG. 4 shows a coin roll diameter sensor S1, which represents the detection system 18 (FIG. 1) and is described below.

As shown in FIG. 3, the front of the frame F is provided with one coin roll diameter sensor S1 and three coin roll perforation sensors S21, S22, S23. The diameter sensor S1 includes a light-emitting unit and a light-receiving unit, which are fastened to the frame F (main body 1*a*) to vertically face each other with the light-transmittable sections 15 of the three drawers 11, 12, 13 positioned between those units. The diameter sensor S1 is positioned (see FIGS. 4 and 5) so that its optical axis runs through the light-transmittable sections 15 located forward of the foremost storage sections 14 of the drawers 11, 12, 13 when they are placed at the closed position (FIG. 4(*b*)).

The perforation sensors S21, S22, S23 are respectively provided for the drawers 11, 12, 13. The perforation sensors S21, S22, S23 each include a light-emitting unit and a light-receiving unit, which are fastened to the frame F (main body 1*a*) and positioned to face each other so as to laterally sandwich the associated drawer 11, 12, 13. Each perforation sensor S21, S22, S23 is positioned so that its optical axis runs at the same height as the center of a coin roll B stored in the associated drawer 11, 12, 13.

A single two-phase rotary encoder E is mounted on the front left-hand side of the frame F. This rotary encoder E is mounted at substantially the same height as the upper drawer 11. As shown in FIG. 5, the rotary encoder E has an input shaft e1 extending downward. Three pinions P, which can engage with the racks R of the drawers 11, 12, 13, are fastened to the input shaft e1. The racks R of the drawers 11, 12, 13 and the pinions P associated with the racks R are positioned so that they engage with each other when at least the associated drawer 11, 12, 13 is placed between the detection start/end position (FIG. 4(*c*)) and detection end/start position (FIG. 4(*d*)) (within the range required for detection by the coin roll detector between the closed position (FIG. 4(*b*)) and pulled-out position (FIG. 4(*e*)) and) and disengage from each other when at least the associated drawer 11, 12, 13 is placed at the closed position.

Since the employed configuration is as described above, the rotary encoder E outputs pulse signals the number of which is proportional to the longitudinal displacement of a drawer 11, 12, 13. In other words, the rotary encoder E, racks R, and pinions P constitute the displacement detector configured to detect the longitudinal displacement of the drawers 11, 12, 13 relative to the main body 1*a*.

Figure 6:
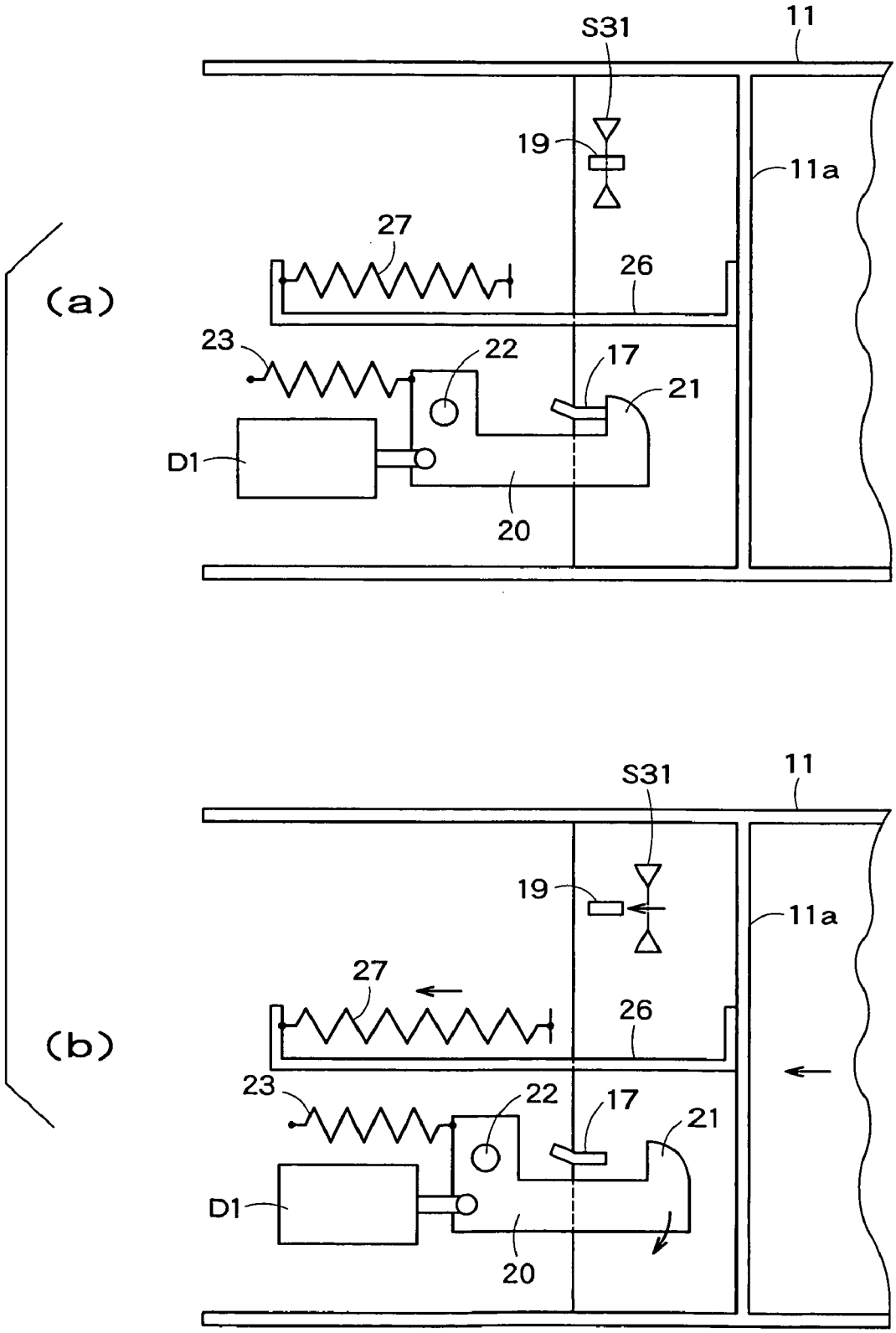
FIG. 6 shows the relationship between a coin roll drawer and associated lock mechanism in the coin roll storage shown in FIG. 2.

FIG. 6 shows the relationship between lock mechanism and a drawer 11, which represents the three drawers 11, 12, 13. FIG. 6(*a*) shows the relationship that prevails when the drawer 11 is placed at the closed position. FIG. 6(*b*) shows the relationship that prevails when the drawer 11 is placed at the pushed-in position. The rear of the drawer 11 is provided with a partition plate 11*a*, extending in a transverse direction. A lock plate 17 and a light-shielding plate 19 are positioned behind the partition plate 11*a* and fastened to the drawer 11. A lock arm 20 and a push-in sensor S31 are provided respectively for the lock plate 17 and light-shielding plate 19. The lock arm 20 and push-in sensor S31 are mounted on the frame F (main body 1*a* shown in FIG. 2), which is shown in FIG. 3. A slide member 26 is attached to the frame F so that the slide member 26 can slide in a longitudinal direction.

The push-in sensor S31 includes a light-emitting unit and a light-receiving unit, which laterally face each other with the light-shielding plate 19 positioned between those units when the drawer 11 is placed at the closed position as indicated in FIG. 6(*a*). The lock arm 20 includes an engagement section 21, which can engage with the front end of the lock plate 17, and a pivot shaft 22, which attaches the arm 20 to the frame F so that the arm 20 can pivot. A pull solenoid or other drive assembly D1 and a return spring 23 are coupled to the arm 20. The drive assembly D1 and return spring 23 function so that the arm 20 can pivot between a lock position at which the engagement section 21 can engage with the lock plate 17 and a release position at which the engagement section 21 is retracted to disengage from the lock plate 17.

A biasing spring 27 is coupled to the slide member 26. The biasing spring 27 biases the slide member 26 toward the front end of the frame F (rightward in FIG. 6). When the drawer 11 is at the closed position as indicated in FIG. 6(*a*), the force of the spring 27 brings the front end of the slide member 26 into contact with the partition plate 11*a* and slightly pushes the drawer 11 forward.

When the drawer 11 is manually pushed in to move it from the closed position (FIG. 6(*a*)) to the pushed-in position (FIG. 6(*b*)), the light-shielding plate 19 retracts so that the output of the sensor S31 changes from a light-shielded state to a light-transmitted state. This causes the drive assembly D1 (under control of the control unit 16 shown in FIG. 7) to pivot the arm 20 until it reaches the release position. When the force applied to push in the drawer 11 is reduced in this state, the force of the spring 27 advances the drawer 11 to a position slightly pulled out from the closed position (between the closed position and the detection start/end position shown in FIG. 4(*c*)). This makes it easy to manually pull out the drawer 11.

When, on the other hand, the drawer 11 is pushed into the main body 1*a* from the pulled-out position, the drawer 11 is pushed into the pushed-in position (FIG. 6(*b*)) against the force of the spring 27. The output of the sensor S31 then changes from a light-transmitted state to a light-shielded state and back to the light-transmitted state. This causes the drive assembly D1 (spring 23) (under control of the control unit 16 shown in FIG. 7) to pivot the arm 20 until it reaches the lock position. When the force applied to push the drawer 11 is reduced in this state, the force of the spring 27 returns the drawer 11 to the closed position, thereby engaging the engagement section 21 of the arm 20 with the lock plate 17. The lock mechanism for the drawers 11, 12, 13, which performs a "locking operation" to inhibit the drawers 11, 12, 13 from being pulled out from the closed position when the drawers are pushed in, is formulated as described above.

If a solenoid is employed as the drive assembly D1 to pivot the arm 20 to the release position only when power is applied, a locked state constantly prevails in the event of a power failure to prevent the drawers from being pulled out of the closed position (no matter whether the drawers are pushed in). This provides increased security when a shop in which the coin roll storage is installed becomes dark due to a power failure.

Figure 7:
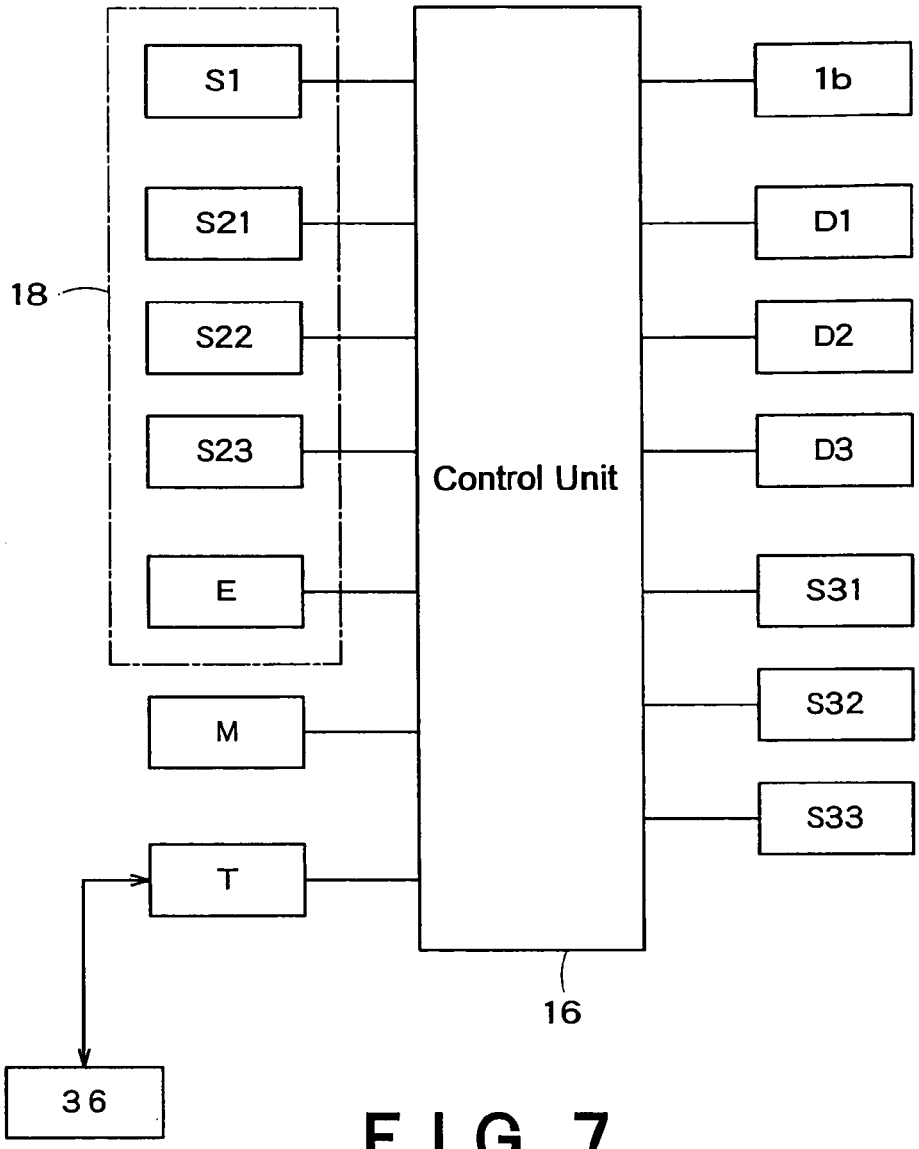
FIG. 7 is a block diagram illustrating a control system for the coin roll storage shown in FIG. 2.

As shown in FIG. 7, the control unit 16 is connected to the diameter sensor S1, coin roll perforation sensors S21, S22, S23, and rotary encoder E, which constitute the aforementioned detection system 18 (see FIG. 3). The control unit 16 is also connected to drive assemblies D1, D2, D3 and push-in sensors S31, S32, S33, which respectively relate to the drawers 11, 12, 13 (see FIG. 6). Further, the control unit 16 is connected to the display panel 1*b* (see FIG. 2), a memory (memory unit) M, and a communication interface T. The memory M holds the predetermined relationship between the locations of the respective storage sections 14 of all drawers 11, 12, 13 and the denomination of the coin rolls to be stored in the respective storage sections 14. The communication interface T establishes a communication connection between the control unit 16 and the control unit 36 of the coin change dispenser 3 (FIG. 1).

In accordance with the longitudinal displacement of a drawer 11, 12, 13 identified by the output of the rotary encoder E and the output of the diameter sensor S1, the control unit 16 functions as a coin roll detector configured to detect the presence and denomination of a coin roll in each storage section 14 of the drawer. The control unit 16 also functions as a detection result transmitter configured to transmit the result of detection by the coin roll detector to the coin change dispenser 3 (via the communication interface T).

Figure 8:
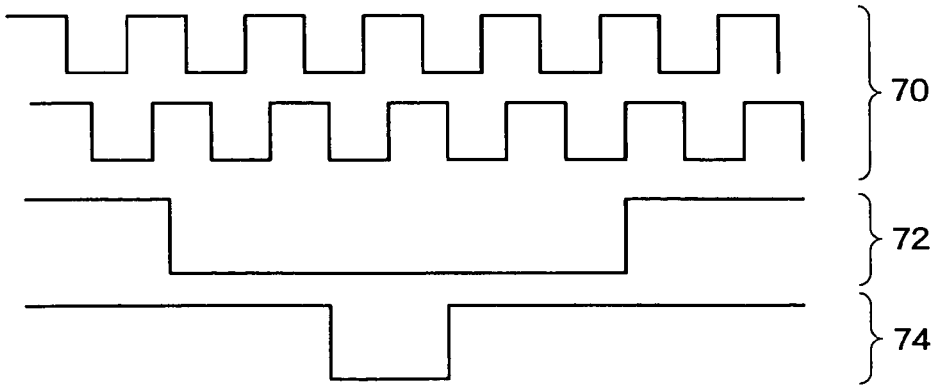
FIG. 8 depicts typical output signals of an encoder and sensors that are shown in FIG. 3.

More specifically, when a coin roll drawer is manually pulled out of/pushed into the storage main body 1*a*, the rotary encoder E, the diameter sensor S1, and the perforation sensor S21, S22, S23 related to the drawer respectively output signals 70, 72, 74 that are partially shown in FIG. 8. The pulse signal 70 output from the rotary encoder E determines the longitudinal displacement of the drawer 11, 12, 13 (each storage section 14) relative to the main body 1*a*, that is, the longitudinal displacement of the drawer 11, 12, 13 (each storage section 14) relative to the sensors S1, S21, S22, S23. The signals 72, 74 output from the sensors S1, S21, S22, S23 determine state transitions between the light-transmitted state and the light-shielded state, which are invoked by radially inner and radially outer circumferences of each coin roll (by only a radially outer circumference when coins of the rolled coin are not perforated unlike 5- or 50-yen coins).

The above makes it possible to determine the presence of a coin roll, the diameter of a stored coin roll, and the presence of a coin roll central perforation in each storage section 14 of a particular coin roll drawer 11, 12, 13. In accordance with the obtained information described above, the control unit 16 can detect whether the coin roll placed in each storage section 14 is of a predetermined denomination.

Further, when a drawer 11, 12, 13 is pushed in, the control unit 16 compares the denomination of a detected coin roll in each storage section 14 of the drawer with the denomination stored in the memory M. If the denomination of the coin roll in any storage section does not match the denomination stored in the memory M, the control unit 16 functions as first controller to inhibit the lock mechanism (the drive assemblies D1, D2, D3 in this instance) from performing the locking operation described earlier.

The number of pulse signals 70 output from the rotary encoder E per unit time when a drawer 11, 12, 13 is pushed in is defined as "pulse rate." Further, a pulse rate change per unit time is defined as "pulse acceleration." More specifically, a timer interrupt process can be used to divide the number of pulse signals 70 during a fixed time interval $\Delta t$ by the time interval $\Delta t$ and handle the obtained value as an approximate "pulse rate." Further, the pulse rate difference between two adjacent time intervals $\Delta t$ can be divided by the time interval $\Delta t$ to determine an approximate "pulse acceleration." When the pulse rate or pulse acceleration exceeds a specific limit, the control unit 16 functions as second controller to inhibit the lock mechanism (drive assemblies D1, D2, D3) from performing the locking operation described earlier.

When the control unit 16 functions as the first or second controller to inhibit the lock mechanism from performing the locking operation, the control unit 16 simultaneously functions as third controller and causes the display panel (display unit) 1*b* to display a warning to the operator. To display such a warning, an indicator lamp for the related drawer may, for instance, blink (at intervals shorter than normal blinking intervals).

[Coin Change Dispenser Configuration]

As shown in FIGS. 1 and 2, the coin change dispenser 3 includes an inlet 30, an outlet 34, and a display/operation panel 3*b* (FIG. 2), which are formed on the front of the housing 3*a*. As shown in FIG. 1, the coin change dispenser 3 also includes identification unit 31, sorting means 32, and a storage section 33. The identification unit 31 is configured to determine the denomination and the number of loose coins introduced into the inlet 30. The sorting means 32 is configured so that the loose coins identified by the identification unit 31 are sorted by denomination. The storage section 33 is configured so that the loose coins sorted by the sorting means 32 are stored by denomination.

The coin change dispenser 3 is configured so that the loose coins stored in the storage section 33 are ejected into the outlet 34 as needed, for instance, to give out change. The loose coins introduced into the inlet 30 include not only coins replenished as change (typically the loose coins obtained by unpacking removed coin roll) but also paid coins received from customers. However, these two types of loose coins are indiscriminatingly stored in the storage section 33 and used as change.

The control unit 36 of the coin change dispenser 3 receives a detection result from the control unit 16 of the coin roll storage 1. When loose coins obtained by unpacking removed coin roll are introduced into the inlet 30, the control unit 36 functions as judgment means for comparing the denomination and the number of the loose coins identified by the identification unit 31 with the denomination and the number of removed coin rolls that are indicated by the received detection result, and judging the correspondence therebetween.

If, for instance, it is judged that the denomination and the number of loose coins are not consistent with the denomination and the number of removed coin rolls (the total number of loose coins of the same denomination does not agree with a value obtained by multiplying the number of coins per coin roll (usually 50) by the number of coin rolls), the log data of the change replenishment management system is flagged or otherwise marked. This makes it possible to accurately manage the correspondence between removed coin rolls and loose coins replenished as change.

When the relationship to the lock mechanism (FIG. 6) of the coin roll storage 1 is considered, it is preferred from the viewpoint of fraudulence prevention that the control unit 36 and control unit 16 exercise control as described below. That is to say, as far as there are a sufficient number of coins of every denomination in the storage section 33 of the coin change dispenser 3, the drawers of the coin roll storage 1 are preferably locked at all times (without regard to the above control) to prevent the drawers from being pulled out of the closed position. This ensures that the drawers of the coin roll storage 1 can be pulled out only when coins need to be replenished to the coin change dispenser 3 from the coin roll storage 1.

OPERATIONAL ADVANTAGES

Operational advantages (functions and effects) of the present embodiment, which is configured as described above, will now be described.

In accordance with the change replenishment management system according to the present embodiment, when loose coins obtained by unpacking removed coin roll are introduced into the inlet 30 of the coin change dispenser 3, the judgment means (control unit 36) of the coin change dispenser 3 can compare the denomination and the number of loose coins identified by the identification unit 31 with the denomination and the number of removed coin roll determined on the basis of the result of detection by the coin roll detector 18 in the coin roll storage 1, and judge the correspondence between the loose coins and the removed coin rolls. This makes it possible to accurately manage the correspondence between the removed coin rolls and the loose coins replenished as change.

In accordance with the coin roll storage 1 according to the present embodiment, when any one of the coin roll drawer 11, 12, 13 is manually pulled out of/pushed into the main body 1*a*, the control unit 16, which functions as the coin roll detector, detects the presence and denomination of a coin roll in each storage section 14 of the same drawer in accordance with the drawer longitudinal displacement determined by the output from the rotary encoder E, which functions as the displacement detector, and with the outputs from the diameter sensor S1 and perforation sensors S21, S22, S23, which are dependent on whether light is blocked by a coin roll. In this instance, the denomination of a coin roll can be detected with reference to a coin roll diameter, which is determined according to the drawer longitudinal displacement and diameter sensor output, and with reference to the presence of a coin roll central perforation, which is determined according to the outputs from the perforation sensors S21, S22, S23. When the drawer longitudinal displacement is used as described above, the diameter of a coin roll can be accurately determined no matter whether the drawer is manually pulled out/pushed in at somewhat varying speeds.

Therefore, the denomination of coin rolls stored in a plurality of storage sections 14 of any one of the drawers 11, 12, 13 can be accurately detected to manage the amount of housed money simply by manually pushing in the same drawer. Further, there is no need to furnish a mechanism or other device for moving the sensor at a fixed speed although it was needed in the past. This makes it possible to reduce the cost of the coin roll storage. Furthermore, the longitudinal displacements of a plurality of drawers 11, 12, 13 can be detected with a single rotary encoder E. This makes it possible to reduce the cost of the displacement detector, thereby further reducing the cost of the coin roll storage.

If an incorrectly stored coin roll is detected in a certain storage section 14 of a drawer 11, 12, 13 (if the coin roll stored in a particular storage section 14 is of a wrong denomination), the lock mechanism does not lock the drawer when it is pushed in. Therefore, the operator who manually pushes in the drawer 11, 12, 13 becomes aware of the incorrectly stored coin roll. Further, the operator who becomes aware of the incorrectly stored coin roll can complete a denomination detection procedure again (perform a retry) simply by pulling out the drawer 11, 12, 13, repositioning the incorrectly stored coin roll, and pushing in the drawer. In other words, the operator can become aware of an incorrectly stored coin roll without delay and immediately perform a retry.

Meanwhile, if a drawer 11, 12, 13 is manually pushed in at an excessively high speed or the rate of its speed change per unit time (acceleration) is too high, an erroneous detection may occur due to coin roll movement within a drawer's storage section 14 or detection failure of the rotary encoder E, which functions as the displacement detector. In view of the above circumstances, when a pulse rate and/or pulse acceleration that corresponds to the drawer speed and/or drawer acceleration exceeds a specific rate limit and/or acceleration limit, respectively, the lock mechanism does not lock the drawer when it is pushed in. This causes the operator, who manually pushes in the drawer 11, 12, 13, to become aware of the possibility of erroneous detection. After the operator becomes aware of the possibility of erroneous detection, the operator can perform a retry simply by pulling out the drawer 11, 12, 13 and then pushing it in. This makes it possible to prevent the amount of housed money from becoming abnormal due to an erroneous detection.

Further, when control is exercised as described above to inhibit the lock mechanism from performing a locking operation, the display panel 1*b* simultaneously displays a warning. This causes the operator to visually recognize the possibility of incorrect storage or erroneous detection and prompts the operator with increased certainty to perform a retry.

MODIFIED EMBODIMENTS (1) The present embodiment assumes that the coin roll storage 1 and coin change dispenser 3 are integral with each other as they are adjacent to each other. However, the coin roll storage 1 and coin change dispenser 3 need not always be integral with each other. In other words, as far as the coin roll storage 1 is positioned near the coin change dispenser 3, the present invention provides an advantage in that coins can be promptly replenished as change to the coin change dispenser 3 from the coin roll storage 1.

(2) The present embodiment assumes that the control unit 36 of the coin change dispenser 3 functions as the judgment means. Alternatively, however, the control unit 50 of the POS register (cash register) 5 may function as the judgment means.

When the above alternative configuration is employed, the control unit 36 of the coin change dispenser 3 may further include coin roll information transmitter and loose coin information transmitter. The coin roll information transmitter transmits the denomination and the number of removed coin roll determined on the basis of the detection result transmitted from the coin roll storage 1, to the POS register 5. The loose coin information transmitter transmits the denomination and the number of loose coins, which are detected by the identification unit 31 when the loose coins obtained by unpacking removed coin roll are introduced into the inlet 30, to the POS register 5. Meanwhile, the control unit 50 of the POS register 5, which functions as the judgment means, may compare the denomination and the number of loose coins with the denomination and the number of removed coin rolls, which are transmitted from the coin change dispenser 3, and judge the correspondence therebetween.

In the above instance, when loose coins obtained by unpacking removed coin roll are introduced into the inlet 30 of the coin change dispenser 3, the judgment means 50 of the cash register 5 can compare the denomination and the number of removed coin roll determined on the basis of the result of detection by the coin roll detector 18 of the coin roll storage 1, with the denomination and the number of loose coins, which are detected by the identification unit 31 of the coin change dispenser 3, and judge the correspondence therebetween.

(3) The present embodiment assumes that the drawers 11, 12, 13 can be pulled out of the main body 1*a* while they are placed between the pushed-in position (FIG. 4(*a*)) and pulled-out position (FIG. 4(*e*)). However, the present invention is not limited to the use of such a configuration. In other words, if the employed configuration permits the lock mechanism to operate when the drawers 11, 12, 13 are placed at the closed position (FIG. 4(*b*)), the present invention is applicable to a case where the drawers 11, 12, 13 can be pulled out of the main body 1*a* while they are placed between the closed position (FIG. 4(*b*)) and pulled-out position.

(4) The present embodiment assumes that the lock mechanism (FIG. 6) operates in accordance with the outputs from the optical sensors S31, S32, S33. Alternatively, however, the lock mechanism may operate in accordance with electrical or mechanical detection results.

(5) The present embodiment assumes that the pinions P are fastened to the input shaft e1 of the rotary encoder E. Alternatively, however, the pinions P need not be fastened to the input shaft e1 as far as they rotate in conjunction with the input shaft e1. For example, other gears and shafts may be interposed between the pinions P and input shaft e1.

(6) If no perforated coins are handled and/or if the coin rolls of handled denomination significantly differ in diameter so that denomination judgments can be properly formulated with only the output signal from the diameter sensor S1, the coin roll perforation sensors S21, S22, S23 may be omitted.

The invention claimed is:

1. A coin roll storage comprising:

a storage main body;

a coin roll drawer arranged to be manually pulled out/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to detect a longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll; and a coin roll detector configured to detect the presence and the denomination of a coin roll in each storage section of the coin roll drawer on the basis of the longitudinal displacement of the coin roll drawer detected by the displacement detector and the output signal from the diameter sensor.

2. A coin roll storage comprising:

a storage main body;

a plurality of coin roll drawers each arranged to be manually pulled out of/pushed into the storage main body in a horizontal longitudinal direction at least between a closed position and a pulled-out position, each of the coin roll drawers being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections thereof;

a displacement detector configured to detect the longitudinal displacement of each coin roll drawer relative to the storage main body;

a coin roll diameter sensor including a light-emitting unit and a light-receiving unit fastened to the storage main body to face each other with the respective light-transmittable sections of the coin roll drawers positioned therebetween, the diameter sensor being configured to output a signal depending on whether light is blocked by a coin roll; and a coin roll detector configured to detect the presence and the denomination of a coin roll in each storage section of any one of the coin roll drawers on the basis of the longitudinal displacement of the same coin roll drawer detected by the displacement detector and the output signal from the diameter sensor.

3. The coin roll storage according to claim 2, the displacement detector including:

a single rotary encoder having an input shaft;

racks mounted on the respective coin roll drawers and extended in the longitudinal direction; and pinions configured to rotate in conjunction with the input shaft of the rotary encoder and arranged in one-to-one relation with the respective racks, wherein each rack and the corresponding pinion engage with each other when the corresponding coin roll drawer is placed within a range required for detection by the coin roll detector between the closed position and the pulled-out position, and disengage from each other when at least the same coin roll drawer is placed at the closed position.

4. A coin roll storage comprising:

a storage main body;

a coin roll drawer arranged to be manually pulled out from/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to detect a longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll;

a coin roll detector configured to detect the presence and the denomination of a coin roll in each storage section of the coin roll drawer on the basis of the longitudinal displacement of the coin roll drawer detected by the displacement detector and the output signal from the diameter sensor;

a memory unit holding the relationship between the location of each coin roll storage section in the coin roll drawer and the denomination of the coin roll to be stored in each coin roll storage section;

a lock mechanism configured to perform a locking operation to inhibit the coin roll drawer from being pulled out from the closed position when the coin roll drawer pulled out of from the storage main body is pushed into the storage main body; and a controller configured to compare the denomination detected by the coin roll detector with the denomination held in the memory unit for each coin roll storage section of the coin roll drawer when the coin roll drawer is pushed in, and to control the lock mechanism not to perform the locking operation if the compared denominations are not consistent with each other for at least one coin roll storage section.

5. The coin roll storage according to claim 4, further comprising a warning display unit controlled by the controller, wherein, the controller is further configured to control the warning display unit to display a warning to an operator when the compared denominations are not consistent with each other for at least one coin roll storage section.

6. A coin roll storage comprising:

a storage main body;

a coin roll drawer arranged to be manually pulled out from/pushed into the storage main body in a horizontal longitudinal direction at least between a closed position and a pulled-out position, the coin roll drawer being provided with a plurality of coin roll storage sections each for storing one coin roll of a particular denomination with an axis of the coin roll pointing in a transverse direction, and formed with a light-transmittable section extending in the longitudinal direction over at least the plurality of coin roll storage sections;

a displacement detector configured to output pulse signals the number of which is proportional to the longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll;

a coin roll detector configured to detect the presence and the denomination of a coin roll in each storage section of the coin roll drawer on the basis of the longitudinal displacement of the coin roll drawer determined by the output signals from the displacement detector and the output signal from the diameter sensor;

a lock mechanism configured to perform a locking operation to inhibit the coin roll drawer from being pulled out from the closed position when the coin roll drawer pulled out of from the storage main body is pushed into the storage main body; and a controller configured to control the lock mechanism not to perform the locking operation if a pulse rate exceeds a specific rate limit and/or a pulse acceleration exceeds a specific acceleration limit when the coin roll drawer is pushed in, the pulse rate being the number of pulse signals output from the displacement detector per unit time, and the pulse acceleration being a change in the pulse rate per unit time.

7. The coin roll storage according to claim 6, further comprising a warning display unit controlled by the controller, wherein, the controller is further configured to control the warning display unit to display a warning to an operator when the pulse rate exceeds the specific rate limit and/or the pulse acceleration exceeds the specific acceleration limit.

8. A control system for a coin roll storage, the system comprising:

a coin roll storage main body;

at least one coin roll drawer arranged to be manually pulled out from/pushed into the storage main body in a horizontal longitudinal direction at least between a closed position and a pulled-out position, the coin roll drawer being provided with a plurality of coin roll storage sections each for storing one coin roll of a particular denomination with an axis of the coin rolling pointing in a transverse direction, and formed with a light-transmittable section extending in the longitudinal direction over at least the plurality of coin roll storage sections;

a displacement detector configured to detect a longitudinal displacement of the coin roll drawer relative to the storage main body;

a coin roll diameter sensor including a light-emitting unit and a light-receiving unit fastened to the storage main body to face each other with the light-transmittable section of the coin roll drawer positioned therebetween, the diameter sensor being configured to output a signal depending on whether light is blocked by a coin roll;

a detection system configured to output a signal for detecting a presence and a denomination of a coin roll in each storage section of the coin roll drawer, in a period which starts when the drawer is pulled out from the storage main body or thereafter, and which ends when the drawer is returned to the closed position or therebefore;

a coin roll detector configured to detect the presence and the denomination of the coin roll in each storage section of the coin roll drawer on the basis of the longitudinal displacement of the coin roll drawer detected by the displacement detector and the output signal from the diameter sensor;

a memory unit holding the relationship between the location of each coin roll storage section in the coin roll drawer and the denomination of the coin roll to be stored in each coin roll storage section;

a lock mechanism configured to perform a locking operation to inhibit the coin roll drawer from being pulled out from the closed position when the coin roll drawer pulled out from the storage main body is pushed into the storage main body; and a controller configured to compare the denomination detected by the coin roll detector with the denomination held in the memory unit for each coin roll storage section of the coin roll drawer when the coin roll drawer is pushed into the storage main body, and to control the lock mechanism not to perform the locking operation if the compared denominations are not consistent with each other for at least one coin roll storage section.

9. The control system according to claim 8, wherein at least the coin roll detector is included in a coin change dispenser communication-connected to the coin roll storage main body.

10. The control system according to claim 8, wherein at least the coin roll detector is included in a cash register communication-connected to the coin roll storage main body.

11. The control system according to claim 8, the coin roll storage further including a coin-roll condition display unit configured to indicate a condition of the coin rolls of at least one denomination to be stored in the coin roll storage.

12. The control system according to claim 11, wherein the coin-roll condition display unit is configured to indicate at least one of full and empty conditions as the condition of the coin rolls.

13. A control system for a coin roll storage, the system comprising:

a coin roll storage main body;

at least one coin roll drawer arranged to be pulled out from/pushed into the storage main body at least between a closed position and a pulled-out position, the coin roll drawer being provided with a plurality of coin roll storage sections each for storing one coin roll of particular denomination;

a detection system configured to output a signal for detecting a presence and a denomination of a coin roll in each storage section of the coin roll drawer, in a period which starts when the drawer is pulled out from the storage main body or thereafter, and which ends when the drawer is returned to the closed position or therebefore;

a lock mechanism configured to perform a locking operation to inhibit the coin roll drawer from being pulled out from the closed position when the coin roll drawer pulled out of the storage main body is pushed into the storage main body;

a warning display unit configured to display a warning to an operator;

a coin roll detector configured to detect the presence and the denomination of the coin roll in each storage section of the coin roll drawer on the basis of the signal output from the detection system;

a memory unit holding the relationship between the location of each coin roll storage section in the coin roll drawer and the denomination of the coin roll to be stored in each coin roll storage section; and a controller configured to compare the denomination detected by the coin roll detector with the denomination held in the memory unit for each coin roll storage section of the coin roll drawer when the coin roll drawer is pushed into the storage main body, and to control the lock mechanism not to perform the locking operation and the warning display unit to display the warning to the operator if the compared denominations are not consistent with each other for at least one coin roll storage section.

14. The control system according to claim 13, wherein at least the coin roll detector is included in a coin change dispenser communication-connected to the coin roll storage main body.

15. The control system according to claim 13, wherein at least the coin roll detector is included in a cash register communication-connected to the coin roll storage main body.

16. The control system according to claim 13, the coin roll storage further including a coin-roll condition display unit configured to indicate a condition of the coin rolls of at least one denomination to be stored in the coin roll storage.

17. The control system according to claim 16, wherein the coin-roll condition display unit is configured to indicate at least one of full and empty conditions as the condition of the coin rolls.

18. A control method for a coin roll storage, the coin roll storage comprising:

a control system comprising;

a coin roll storage main body, at least one coin roll drawer arranged to be pulled out from/pushed into the storage main body at least between a closed position and a pulled-out position, the coin roll drawer being provided with a plurality of coin roll storage sections each for storing one coin roll of a particular denomination, and a lock mechanism configured to perform a locking operation to inhibit the coin roll drawer from being pulled out from the closed position when the coin roll drawer pulled out from the storage main body is pushed into the storage main body, the control method comprising the steps of:

detecting, with the control system, a presence and a denomination of a coin roll in each storage section of the coin roll drawer, in a period which starts when the drawer is pulled out from the storage main body or thereafter, and which ends when the drawer is returned to the closed position or therebefore;

judging, with the control system, whether at least one coin roll is incorrectly stored in the coin roll storage section for storing another coin roll of a different denomination or not, on the basis of a detection result in the detecting step; and controlling, with the control system, the lock mechanism not to perform the locking operation when the coin roll drawer is pushed into the storage main body, if at least one coin roll is judged in the judging step to be incorrectly stored.

19. A control method for a coin roll storage, the coin roll storage comprising:

a control system comprising;

a coin roll storage main body, at least one coin roll drawer arranged to be pulled out from/pushed into the storage main body at least between a closed position and a pulled-out position, the coin roll drawer being provided with a plurality of coin roll storage sections each for storing one coin roll of a particular denomination, and a lock mechanism configured to perform a locking operation to inhibit the coin roll drawer from being pulled out from the closed position when the coin roll drawer pulled out from the storage main body is pushed into the storage main body, the control method comprising the steps of:

detecting, with the control system, a presence and a denomination of a coin roll in each storage section of the coin roll drawer, in a period which starts when the drawer is pulled out from the storage main body or thereafter, and which ends when the drawer is returned to the closed position or therebefore;

judging, with the control system, whether at least one coin roll is incorrectly stored in the coin roll storage section for storing another coin roll of a different denomination or not, on the basis of a detection result in the detecting step; and controlling, with the control system, the lock mechanism not to perform the locking operation when the coin roll drawer is pushed into the storage main body and a warning display unit to display a warning to an operator, if at least one coin roll is judged in the judging step to be incorrectly stored.

* * * * *